US012253302B2

(12) United States Patent
Alves Ferreira et al.

(10) Patent No.: US 12,253,302 B2
(45) Date of Patent: Mar. 18, 2025

(54) REFRIGERATOR APPLIANCE WITH TWO HALF SHELVES SUPPORTED BY A CANTILEVER ARM

(71) Applicant: WHIRLPOOL CORPORATION, Benton Harbor, MI (US)

(72) Inventors: Luiz Afranio Alves Ferreira, Joinville (BR); Arthur Sady Abreu Marcon, St. Joseph, MI (US); Ualisson Ferreira Da Silva, Joinville (BR); Gustavo Spezzia, Joinville (BR); Matheus Pereira Zappelini, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 102 days.

(21) Appl. No.: 18/162,863

(22) Filed: Feb. 1, 2023

(65) Prior Publication Data

US 2024/0255214 A1 Aug. 1, 2024

(51) Int. Cl.
*F25D 25/02* (2006.01)
*A47B 96/02* (2006.01)

(52) U.S. Cl.
CPC ..... *F25D 25/02* (2013.01); *A47B 96/027* (2013.01); *A47B 2210/175* (2013.01); *F25D 2325/022* (2013.01)

(58) Field of Classification Search
CPC .. F25D 23/067; F25D 25/02; F25D 2325/022; A47B 96/027; A47B 2210/175
See application file for complete search history.

(56) References Cited

U.S. PATENT DOCUMENTS

| | | | | |
|---|---|---|---|---|
| 5,340,209 | A | 8/1994 | Kolbe et al. | |
| 5,893,620 | A | 4/1999 | Birgelis | |
| 6,347,530 | B1 | 2/2002 | Kim | |
| 8,282,178 | B2 | 10/2012 | Bradley et al. | |
| 10,174,993 | B2 | 1/2019 | Choi et al. | |
| 10,670,327 | B1 | 6/2020 | Haenssler et al. | |
| 2016/0278519 | A1 | 9/2016 | Seeley | |
| 2018/0087828 | A1 | 3/2018 | Park et al. | |
| 2019/0360742 | A1* | 11/2019 | Wantland | F25D 23/067 |
| 2019/0360744 | A1 | 11/2019 | Hanson | |
| 2019/0390894 | A1* | 12/2019 | Jang | F25D 25/02 |
| 2021/0055041 | A1 | 2/2021 | Staud et al. | |
| 2021/0102750 | A1 | 4/2021 | Voltarelli et al. | |
| 2021/0222945 | A1 | 7/2021 | Hanson et al. | |

FOREIGN PATENT DOCUMENTS

| | | | |
|---|---|---|---|
| CN | 205641793 U | * | 10/2016 |
| EP | 2457042 B1 | | 4/2019 |
| EP | 4411295 A1 | | 8/2024 |

* cited by examiner

*Primary Examiner* — Matthew W Ing
(74) *Attorney, Agent, or Firm* — Brooks Kushman P.C.

(57) ABSTRACT

A refrigerator appliance includes a liner defining a cavity having a back wall and opposing first and second sidewalls. An elongate shelf-support ladder is arranged vertically on the back wall and positioned centrally. A central arm has a rear portion attached to the ladder such that the arm is cantilevered from the ladder. A shelf assembly is supported by the central arm and includes a first shelf surface located between the first sidewall and the arm and a second shelf surface located between the second sidewall and the arm.

18 Claims, 4 Drawing Sheets

REFRIGERATOR APPLIANCE WITH TWO HALF SHELVES SUPPORTED BY A CANTILEVER ARM

TECHNICAL FIELD

This disclosure relates to refrigerator appliances and more particularly to shelving systems.

BACKGROUND

In order to keep food fresh, a low temperature must be maintained within a refrigerator to reduce the reproduction rate of bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

According to one embodiment, a refrigerator appliance includes a liner defining a cavity having a back wall and opposing first and second sidewalls. An elongate shelf-support ladder is arranged vertically on the back wall and positioned centrally. A central arm has a rear portion attached to the ladder such that the arm is cantilevered from the ladder. A shelf assembly is supported by the central arm and includes a first shelf surface located between the first sidewall and the arm and a second shelf surface located between the second sidewall and the arm.

In some embodiments, a first distance between the first sidewall and the ladder is substantially equal to a second distance between the second sidewall and the ladder. The refrigerator appliance may only have one ladder. The ladder may be received in a slot that is formed in a back cover associated with the air-circulation system. The first and second panes may be glass. The shelf assembly may further include a rear support connecting at least the first pane to the arm. In some embodiments, the shelf assembly includes first and second rear supports each associated with a corresponding one of the panes. In other embodiments, only a single rear support is used to support both panes. The one or more rear supports may be arranged orthogonal to the arm. The one or more rear supports may each define a channel, and a rear edge of the associated pane is received in the channel. The first pane may define a groove and the channel of the first rear support may have a projection received in the groove to secure the first pane to the first rear support. If two rear supports are used, the second pane may define a groove and the channel of the second rear support may have a projection received in the groove to secure the second pane to the second rear support.

In further embodiments, the shelf assembly may further include a first rear bracket connected to the arm and extending toward the first wall and a second rear bracket connected to the arm and extending toward the second wall, wherein the first rear bracket supports the first pane to the arm and the second rear bracket supports the second pane to the arm. The first rear bracket may define a channel that receives a rear edge of the first pane, and the second rear bracket may define a channel that receives a rear edge of the second pane. The arm may have first and second opposing sidewalls, wherein the first rear bracket includes a connector received on a top edge of the first sidewall, and the second rear bracket includes a connector received on a top edge of the second sidewall. Each connector may include an anti-rotation tab configured to engage with a corresponding one of the first and second sidewalls of the arm.

In one or more embodiments, the shelf assembly may further include a first front bracket connected to the arm and extending toward the first wall and a second front bracket connected to the arm and extending toward the second wall, wherein the first front bracket supports the first pane to the arm and the second front bracket supports the second pane to the arm.

According to another embodiment, a refrigerator appliance includes a liner defining a cavity having a back wall and opposing first and second sidewalls. An elongate shelf-support ladder is arranged vertically on the back wall and positioned centrally. A central arm has a rear portion attached to ladder such that the arm is cantilevered from the ladder. A first shelf includes a first planar body and a first rear support member received on a rear portion of the first planar body. The first rear support member is connected to the arm and extends therefrom towards the first sidewall. The second shelf includes a second planar body and a second rear support member received on a rear portion of the second planar body. The second rear support member is connected to the arm and extends therefrom towards the second sidewall.

In some embodiments, the first sidewall of the liner defines a support rail and the first rear support member has a connector rotatably connected to the support rail such that the first shelf is pivotal relative to the support rail. The connector may include a planar portion configured to rest on top of the support rail and a hooked portion configured to partially extend around the support rail. The first shelf may further include a first front support member received on a front portion of the first planar body. The first front support member may be connected to the arm and extend therefrom towards the first sidewall.

According to yet another embodiment, a shelving system of a refrigerator appliance includes an elongate shelf-support ladder configured to be arranged vertically on a back wall of a fresh-food compartment. A central arm has a rear portion attached to ladder such that the arm is cantilevered from the ladder. A first shelf includes a first planar body and a first rear support member received on a rear portion of the first planar body. The first rear support member is connected to the arm. A second shelf includes a second planar body and a second rear support member received on a rear portion of the second planar body. The second rear support member is connected to the arm.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
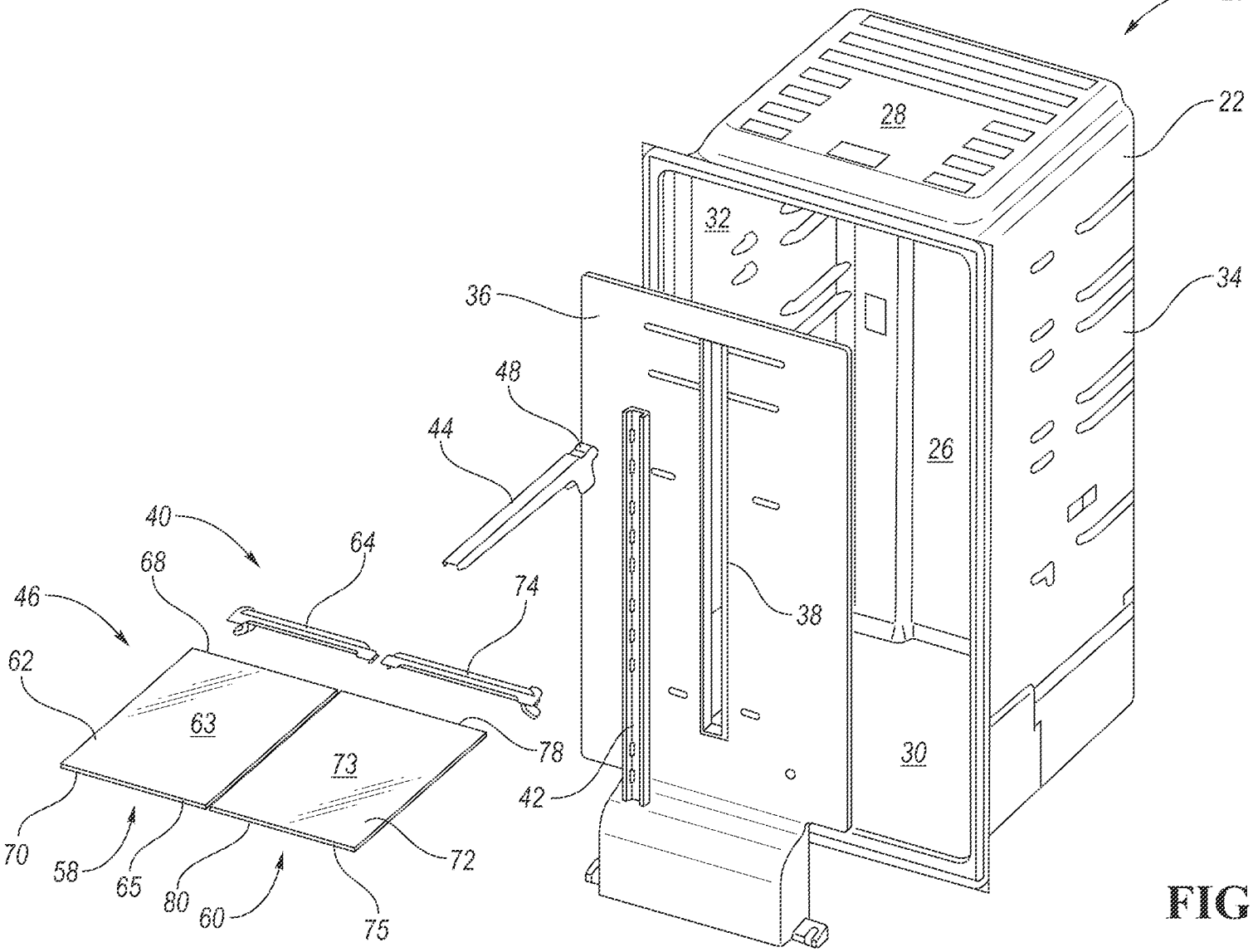
FIG. 1 is an exploded perspective view of a refrigerator appliance.
Figure 2:
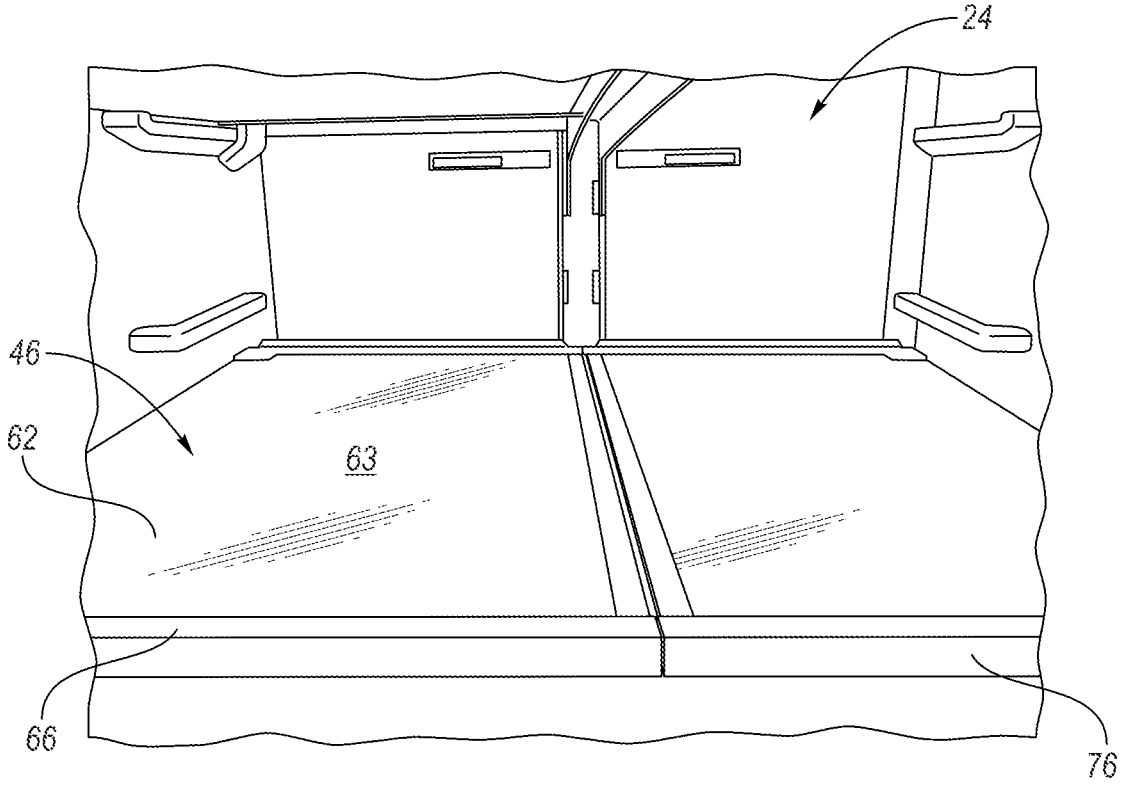
FIG. 2 is a partial front perspective view of the refrigerator appliance.

Referring to FIGS. 1 and 2, a refrigerator appliance 20 includes an outer housing or cabinet (not shown) that forms the exterior of the appliance 20. Within the cabinet are one or more compartments or cavities such as a fresh-food compartment 24 and a freezer compartment. The refrigerator appliance 20 may include one or more liners that define the compartments. For example, a liner 22 defines the fresh-food compartment 24. The liner 22 includes a back wall 26, a top wall 28 a bottom wall 30, and opposing first and second sidewalls 32 and 34 that cooperate to define the compartment or cavity 24. While not shown, a second liner may be used to form the freezer compartment. The freezer compartment may be disposed above or below the fresh-food compartment 24. In one embodiment, the refrigerator appliance 20 is a so-called "French-style refrigerator" having the fresh-food compartment 24 on top and the freezer compartment below. One or more doors (not shown) are attached to the cabinet to seal the one or more compartments.

The refrigerator 20 includes an air circulation system for cooling the compartment 24. The air circulation system may include a cover 36 disposed against the back wall 26 of the liner 22. An air gap may be provided between the back wall 26 and the cover 36. The cover 36 may define a vertical slot 38 centered on the back wall 26 such that a first distance between the first sidewall and the ladder is substantially equal to a second distance between the second sidewall and the ladder. Herein, substantially equal means within 5 percent. Additional openings may be provided in the cover 36 in addition to the vertical slot. Of course, other types of air circulation systems are contemplated, and this disclosure is not limited to systems that include the cover 36.

The refrigerator appliance 20 has a shelving system 40 configured to support food items stored within the fresh-food compartment 24. The shelving system 40 includes an elongate shelf-support ladder 42 arranged vertically on the back wall 24 and positioned centrally. The support ladder 42 may be received in the slot 38 and secured to the liner 22 by fasteners or other joining techniques. The ladder 42 forms the backbone of the shelving system 40 and is a main structural component. One or more shelf assemblies 46 of the system 40 are supported by the ladder 42.

Figure 3:
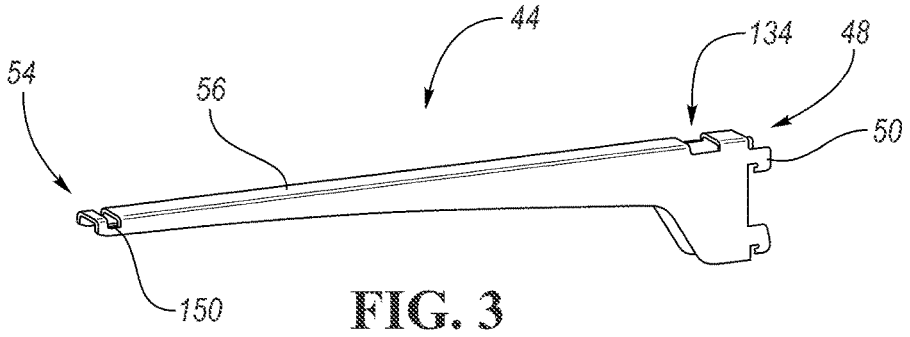
FIG. 3 is a perspective view of a central support arm of a shelving system.
Figure 4:
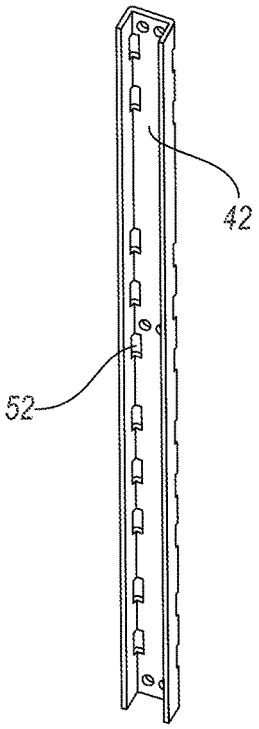
FIG. 4 is a perspective view of a support ladder of the shelving system.

Referring to FIGS. 3 and 4, each shelf assembly 46 may include a central arm 44 attached to the support ladder 42. The central arm 44 has a rear portion 48 configured to connect with the ladder 42. The rear portion 48 may include connection features 50, e.g., hooks, configured to engage with connection features 52, e.g., slots or openings, of the ladder 42. The arm is 44 designed to only attach at the rear portion 48 and cantilever from the ladder 42. The ladder 42 has a plurality of connection features 52 allowing the arm 44 to be placed at various heights. The arm 44 extends forwardly from the rear portion 48 located at a back of fresh-food compartment 24 to a front portion 54 located at the front of the fresh-food compartment 24. The arm 44 includes a planar top surface 56 that generally extends between the rear portion 48 and the front portion 54.

Referring back to FIGS. 1 and 2, each shelf assembly 46 further includes a pair of half shelves 58 and 60 supported by a common central arm 44. The half shelf 58 may include a pane 62, e.g., glass, a rear support member or brace 64 and a front support member or brace 66. The pane 62 includes an upper surface 63 configured to support food items and a lower surface 65. The rear support member 64 is received on a rear edge 68 of the pane 62. The front support member 66 is received on a front edge 70 of the pane 62. The half shelf 60 may include a pane 72, e.g., glass, a rear support member or brace 74 and a front support member or brace 76. The pane 72 includes an upper surface 73 configured to support food items and a lower surface 75. The rear support member 74 is received on a rear edge 78 of the pane 62. The front support member 66 is received on a front edge 80 of the pane 72.

Figure 6:
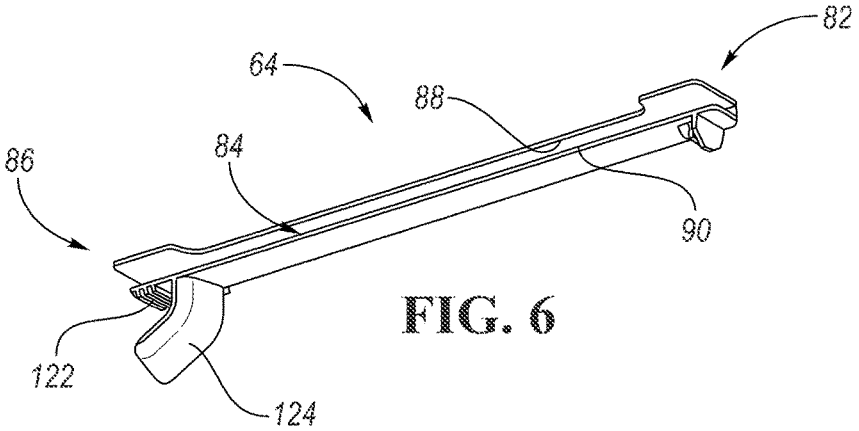
FIG. 6 is a perspective view of a rear support member of the shelving system.

Referring to FIG. 6, the rear support 64 may be an elongate member having an inside end 82 and an outside end 86. A channel 84 may extend between the inside end 82 and the outside end 86 and has an upper planar portion 88 and a lower planar portion 90. The channel 84 is configured to receive the rear edge 68 of the pane 62 therein with the upper planar portion 88 disposed on the upper surface 63 and the lower planar portion 90 disposed against the lower surface 65. The length of the channel 84 may be substantially the same as the length of the rear edge 68.

Figure 7:
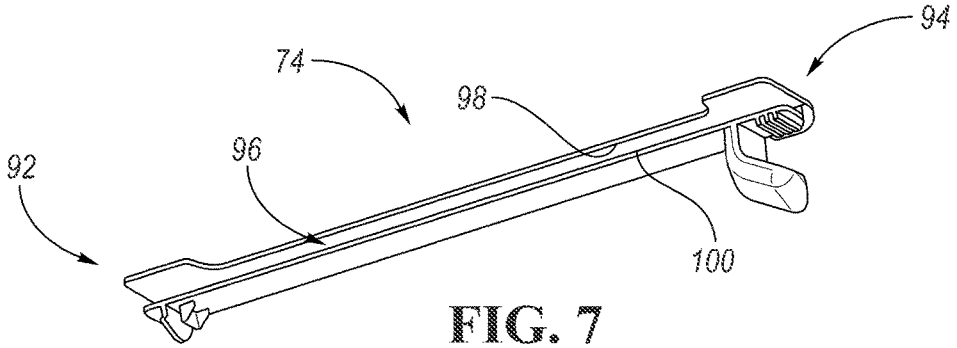
FIG. 7 is a perspective view of another rear support member of the shelving system.

Referring to FIG. 7, the rear support 74 may be an elongate member having an inside end 92 and outside end 94. A channel 96 may extend between the inside end 92 and the outside end 94 and has an upper planar portion 98 and a lower planar portion 100. The channel 96 is configured to receive the rear edge 78 of the pane 72 therein with the upper planar portion 98 disposed on the upper surface 73 and the lower planar portion 100 disposed against the lower surface 75. The length of the channel 96 may be substantially the same as the length of the rear edge 78.

Figure 5:
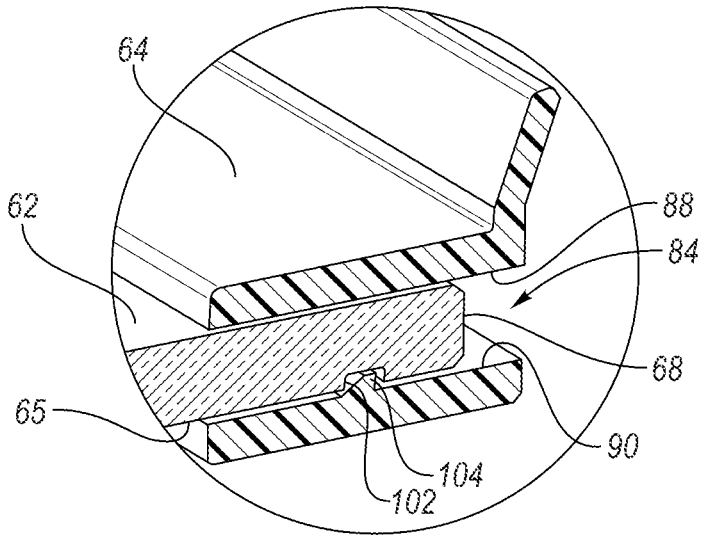
FIG. 5 is a cross-sectional view of a rear portion of a shelf of the shelving system.

Referring to FIG. 5, the rear support 64 and the pane 62 may include connection features for securing the rear support 64 to the pane 62. In one embodiment, the pane 62 defines a groove 102 recessed into the bottom surface 65 and extending in the width direction of the pane 62. The groove 102 is located near the rear edge 68 so that it is received within the channel 84. The groove 102 may or may not extend across the entire width of the pane 62. In some embodiments, the groove 102 may be a plurality of discontinuous grooves that are linearly arranged in the width direction.

The rear support 64 may include a projection 104 that is located within the channel 84 and configured to be received within the groove 102. The projection 104 may extend in the width direction, i.e., between the inner and outer ends 82/86. In the illustrated embodiment, the projection 104 extends upwardly from the lower planar portion 90. In some embodiments, the projection 104 may be a plurality of discontinuous projections that are linearly arranged in the width direction to match the discontinuous grooves of the pane 62.

While the groove 102 and the projection 104 are illustrate as being on the bottom, they can be flipped in other embodiments and be provided on the top. In other embodiments, the projection may be of the pane 62 and the groove may be formed in the rear support 64.

The rear support 74 may be attached to the pane 72 in the same or similar way as described above with regards to pane 62 and rear support 64. For brevity, this connection will not be described again. In some embodiments, the pair of rear supports may instead be a single rear support for both panes.

Figure 8:
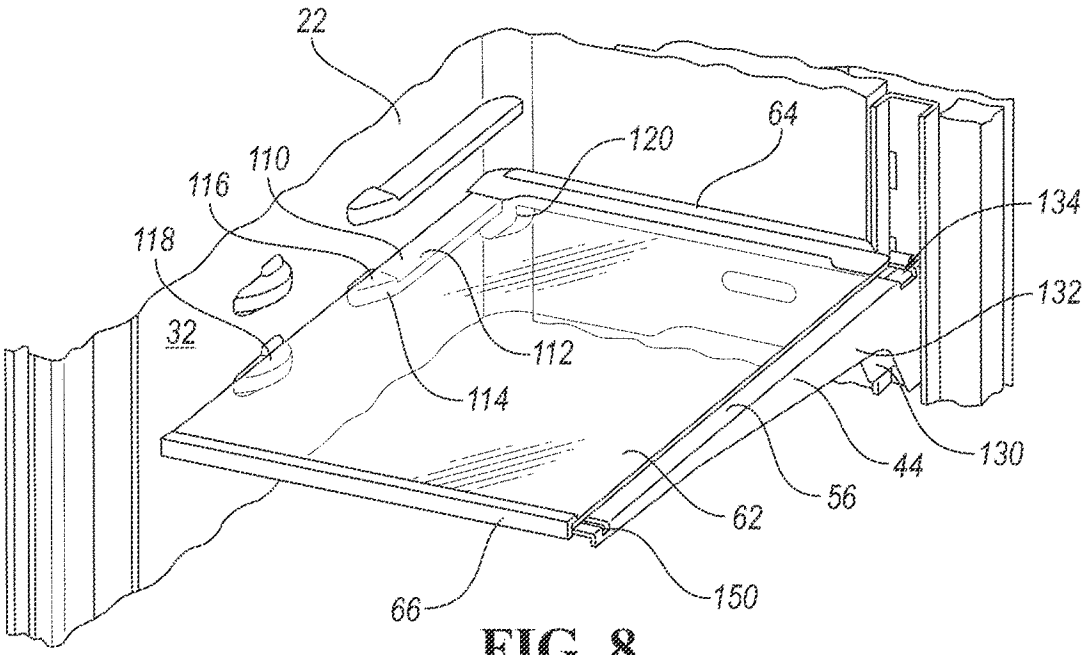
FIG. 8 is a partial perspective view of the shelving system installed within the refrigerator appliance.
Figure 9:
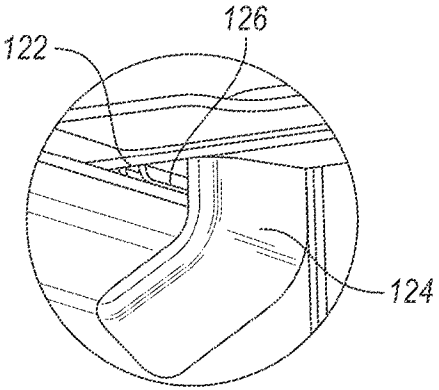
FIG. 9 is a perspective view of a connector of the rear support member of FIG. 6.

Referring to FIGS. 8 and 9, in one or more embodiments, each half shelf is supported centrally by the arm 44 and on the outside by a support member of the liner 22. For example, the sidewall 32 of the liner 22 defines a support rail 110 configured to engage with the rear support 64. The support rail 110 may be an integrally formed feature of the liner 22 or maybe a standalone component that is attached to the liner 22. The support rail 110 projects outwardly from the sidewall 32 and includes a top 112 and a bottom 114. The top 112 may include a planar surface 116 configured to engage with the bottom side 65 of the pane 62. A second support rail 118 may be placed in front of the support rail 110 and is also configured to engage with the bottom side 65 of the pane 62. The front support rail 118 may be smaller than the rear support rail 110.

The rear support member 64 may have a connector 120 that is rotatably connected to the support rail 110 such that the first shelf 58 is pivotal relative to the support rail 110. The connector 120 may include a planar portion 122 configured to rest on the top 112 of the support rail 110 and a hooked portion 124 configured to partially extend around the rail 110. The planar portion 122 may include a plurality of ribs 126.

Figure 10:
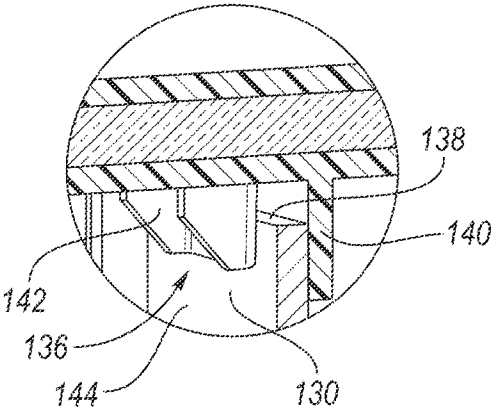
FIG. 10 is a perspective view, in cross section, of another connector of the rear support member of FIG. 6.

Referring to FIGS. 8 and 10, the arm 44 may have first and second opposing sidewalls 130 and 132 that are spaced apart from each other such that the interior of the arm 44 is generally hollow. Each of the sidewalls 130, 132 may extend from the rear portion 48 to the tip 54 of the arm 44. The rear support 64 may be supported by the first sidewall 130 and the rear support 74 is supported by the second sidewall 132. The central arm 44 may define a rear cut out 134 in the top surface 56 allowing the rear supports 64, 74 to engage with the sidewalls 130, 132.

In one example embodiment, the rear support 64 includes a connector 136 configured to connect the rear support 64 to the central arm 44. The connector 136 may be received on a top edge 138 of the first sidewall 130. The connector 136 may include an inner member 140 depending downwardly into the arm 44 and configured to be received against the inner surface 141 of the sidewall 130. The connector 136 may also include an anti-rotation tab 142 disposed on the outside of the arm 44 and configured to engage with the outer surface 144 of the sidewall 130. The anti-rotation tab 142 inhibits excessive rotation of the shelf 58 in the downward direction.

Figure 11:
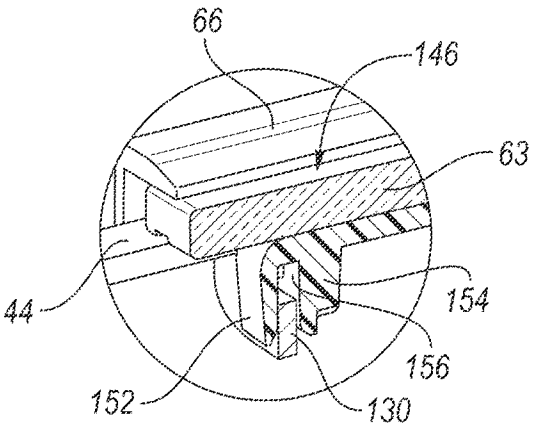
FIG. 11 is a perspective view, in cross section, of a connector of a front support member of the shelving system.

Referring to FIGS. 8 and 11, the front supports 66 and 76 may also attached to the central arm 44. For example, the front support 66 may include a connector 146 that is received within a slot or opening 150 of the central arm 44. The connector 146 may also be received on the first sidewall 130. The connector 146 may include first and second portions 152 and 154 that cooperate to define a vertical slot 156 received on the sidewall 130.

The shelf 58 may be installed by positioning the shelf 58 at an angle and aligning the pane 62 onto the front and rear support rails 118 and 110 with the connector 120 of the rear bracket 64 received around the rear support rail 110. The shelf 58 is then pivoted downwardly until the connector 34 of the rear support 64 and the connector 154 of the front support engage with the central arm 44. The lower side 65 of the pane 62 is supported by the upper surface 56 of the arm 44.

For brevity, only the connections for the shelf 58 are described. However, it is to be understood that the other shelves may be supported within the refrigerator appliance 20 in a similar or same manner. Only one shelve assembly is shown, it is to be understood that the ladder 42 can support a plurality of shelve assemblies that are arranged vertically relative to each other.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A refrigerator appliance comprising:

a liner defining a cavity having a back wall and opposing first and second sidewalls;

an elongate shelf-support ladder arranged vertically on the back wall and positioned centrally;

a central arm having a rear portion attached to the ladder such that the arm is cantilevered from the ladder, wherein the central arm further has a top and first and second sidewalls depending from opposing sides of the top; and a shelf assembly supported by the central arm and including:

a first rear support connected to the first sidewall of the central arm, wherein the first rear support includes a connector received on a top edge of the first sidewall of the arm, a first shelf surface located between the first sidewall of the cavity and the arm and supported by the first rear support, wherein the second rear support includes a connector received on a top edge of the second sidewall of the arm, a second rear support connected to the second sidewall of the central arm, and a second shelf surface located between the second sidewall of the cavity and the arm and supported by the second rear support.

2. The refrigerator of claim 1, wherein a first distance between the first sidewall of the cavity and the ladder is substantially equal to a second distance between the second sidewall of the cavity and the ladder.

3. The refrigerator of claim 1, wherein the shelf assembly further includes a first pane defining the first shelf surface and a second pane defining the second shelf surface.

4. The refrigerator of claim 3, wherein the first rear support defines a channel, and a rear edge of the first pane is received in the channel.

5. The refrigerator of claim 4, wherein the first pane defines a groove, and the channel has a projection received in the groove to secure the first pane to the rear support.

6. The refrigerator of claim 3, wherein the first and second panes are glass.

7. The refrigerator of claim 1, wherein first rear support is arranged orthogonal to the arm, and the second rear support is arranged orthogonal to the arm.

8. The refrigerator of claim 1, wherein the first rear support defines a channel that receives a rear edge of the first pane, and the second rear support defines a channel that receives a rear edge of the second pane.

9. The refrigerator of claim 1, wherein each connector includes an anti-rotation tab configured to engage with a corresponding one of the first and second sidewalls of the arm.

10. The refrigerator of claim 1, wherein the shelf assembly further includes a first front support connected to the first sidewall of the arm and extending toward the first sidewall of the cavity and a second front support connected to the second sidewall of the arm and extending toward the second sidewall of the cavity, wherein the first front support is connected to the first shelf surface and the second front support is connected to the second shelf surface.

11. The refrigerator of claim 1, wherein the refrigerator appliance only includes one shelf-support ladder in the cavity.

12. The refrigerator of claim 1 further comprising a cover disposed on the back wall and defining a central slot extending vertically, wherein the ladder is disposed in the central slot.

13. A refrigerator appliance comprising:

a liner defining a cavity having a back wall and opposing first and second sidewalls, wherein the first sidewall of the liner defines a support rail;

an elongate shelf-support ladder arranged vertically on the back wall and positioned centrally;

a central arm having a rear portion attached to ladder such that the arm is cantilevered from the ladder;

a first shelf including a first planar body and a first rear support member received on a rear portion of the first planar body, the first rear support member being connected to the arm and extending therefrom towards the first sidewall, wherein the first rear support member has a connector rotatably connected to the support rail such that the first shelf is pivotal relative to the support rail, wherein the connector includes a planar portion configured to rest on top of the support rail and a hooked portion configured to partially extend around the support rail; and a second shelf including a second planar body and a second rear support member received on a rear portion of the second planar body, the second rear support member being connected to the arm and extending therefrom towards the second sidewall.

14. The refrigerator appliance of claim 13, wherein the second sidewall of the liner defines a second support rail, and the second rear support member has a connector rotatably connected to the second support rail such that the second shelf is pivotal relative to the second support rail.

15. The refrigerator appliance of claim 13, wherein the first shelf further includes a first front support member received on a front portion of the first planar body, the first front support member being connected to the arm and extending therefrom towards the first sidewall.

16. A shelving system of a refrigerator appliance comprising:

an elongate shelf-support ladder configured to be arranged vertically on a back wall of a fresh-food compartment;

a central arm having a rear portion attached to ladder such that the arm is cantilevered from the ladder, wherein the central arm further has first and second opposing sidewalls and a top surface extending from the first sidewall to the second sidewall;

a first shelf including a first planar body and a first rear support member received on a rear portion of the first planar body, the first rear support member being connected to the first sidewall of the central arm, wherein the first rear support member includes a connector received on a top edge of the first sidewall of the arm; and a second shelf including a second planar body and a second rear support member received on a rear portion of the second planar body, the second rear support member being connected to the second sidewall of the central arm.

17. The shelving system of claim 16, wherein the second rear support member includes another connector received on a top edge of the second sidewall of the arm.

18. The shelving system of claim 16, wherein the first rear support member includes a second connector configured to pivotally connect with a support rail of a liner of the refrigerator appliance.

* * * * *